US007892073B1

(12) United States Patent
Smania et al.

(10) Patent No.: US 7,892,073 B1
(45) Date of Patent: Feb. 22, 2011

(54) BOWLING BALL ABRADER AND POLISHER SYSTEM AND METHOD

(75) Inventors: Gary Louis Smania, Las Vegas, NV (US); John M. Brandt, Las Vegas, NV (US)

(73) Assignee: Gary L. Smania, Las Vegas, NV (US)

( * ) Notice: Subject to any disclaimer, the term of this patent is extended or adjusted under 35 U.S.C. 154(b) by 0 days.

(21) Appl. No.: 12/686,339

(22) Filed: Jan. 12, 2010

Related U.S. Application Data

(60) Provisional application No. 61/143,894, filed on Jan. 12, 2009.

(51) Int. Cl.
*B24B 1/00* (2006.01)
*B24B 23/02* (2006.01)

(52) U.S. Cl. ..... 451/50; 15/21.2; 451/59; 451/359

(58) Field of Classification Search ..... 451/49, 451/50, 57, 59, 259, 359; 15/21.2, 97.1
See application file for complete search history.

(56) References Cited

U.S. PATENT DOCUMENTS

| | | | | |
|---|---|---|---|---|
| 1,694,900 | A * | 12/1928 | Zimmerling | 451/259 |
| 2,405,344 | A * | 8/1946 | Cloutier | 451/50 |
| 2,479,898 | A * | 8/1949 | Beaudette | 15/93.1 |
| 3,714,703 | A | 2/1973 | Maples | |
| 5,484,329 | A | 1/1996 | Engelbrektson | |
| 5,613,896 | A | 3/1997 | Haus et al. | |
| 6,186,875 | B1 | 2/2001 | Cook et al. | |
| 6,402,600 | B1 | 6/2002 | Besch | |
| 6,439,982 | B1 | 8/2002 | Klukos | |
| 6,746,315 | B2 | 6/2004 | Klukos | |
| 6,761,622 | B2 | 7/2004 | Nam | |
| 2003/0049996 | A1 * | 3/2003 | Nam | 451/178 |
| 2006/0111029 | A1 * | 5/2006 | Sim | 451/491 |
| 2009/0298400 | A1 * | 12/2009 | Shim | 451/267 |

* cited by examiner

*Primary Examiner*—Timothy V Eley
(74) *Attorney, Agent, or Firm*—Gary L. Smania; John M. Brandt

(57) ABSTRACT

A bowling ball abrader and polisher utilizes cooperative rotational inter-engagement between a cup-shaped abrading an polishing tool and a non-motorized rotating ball holder assembly to obtain even, concentric abrasion patterns on a bowling ball surface. Upon placement of a bowling ball in a ball cradling surface formed in the rotating ball holder, application of the rotating abrading and polishing tool on the surface of the bowling ball causes a corresponding rotation of the bowling ball using the non-motorized rotating ball holder, which enables the outer surface of the bowling ball to be more uniformly abraded and polished.

12 Claims, 2 Drawing Sheets

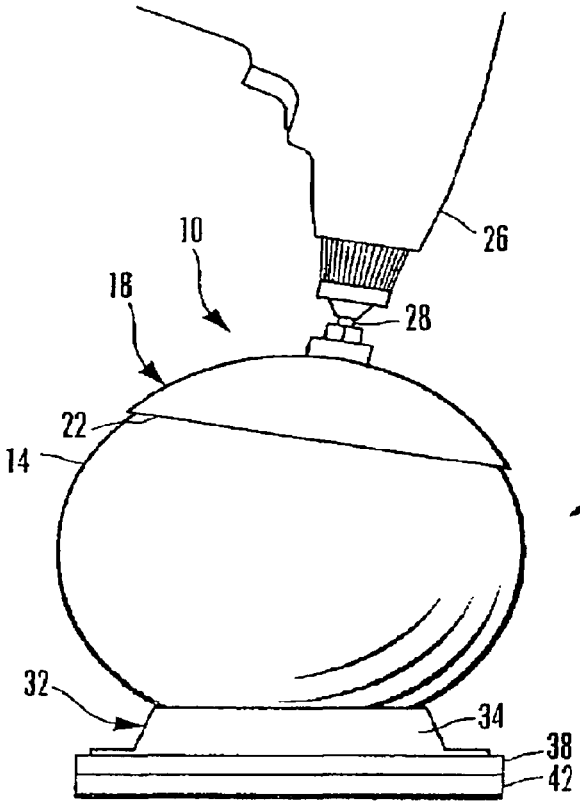
Figure 1
Figure 2A
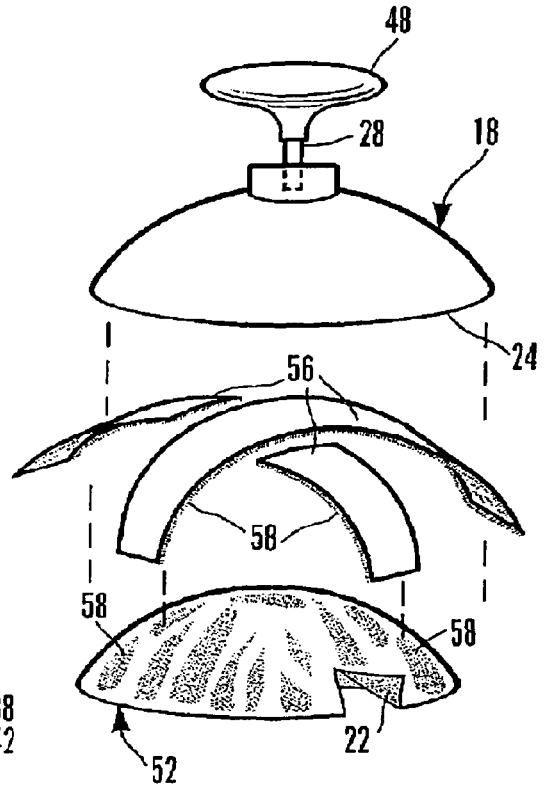
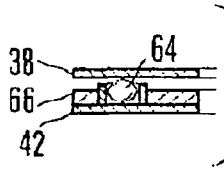
Figure 2B
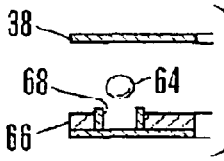
Figure 2C
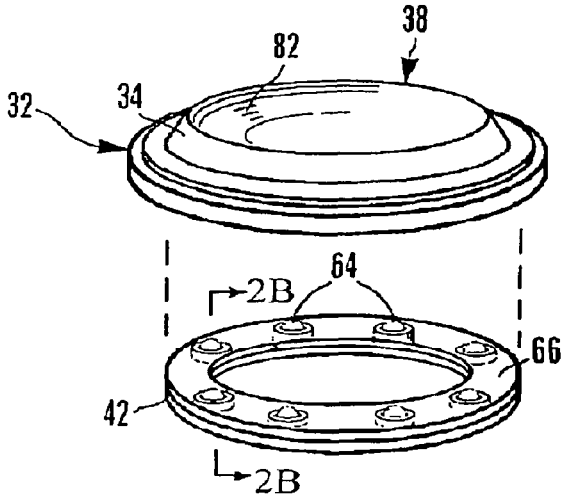

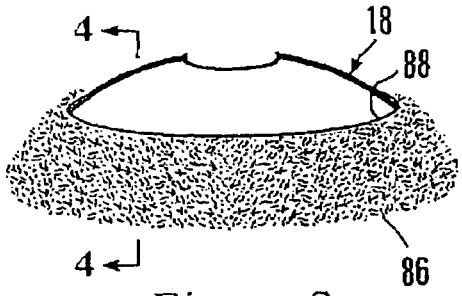
Figure 3
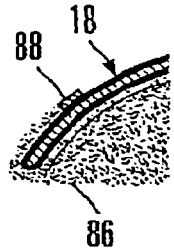
Figure 4
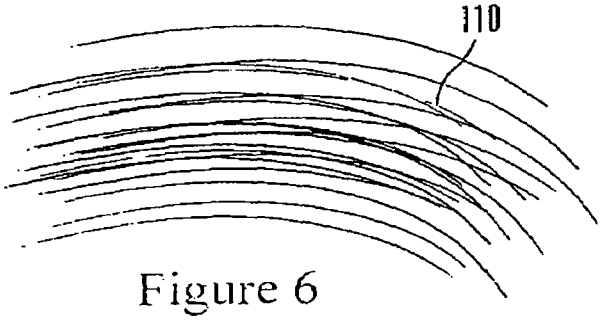
Figure 6
Figure 7
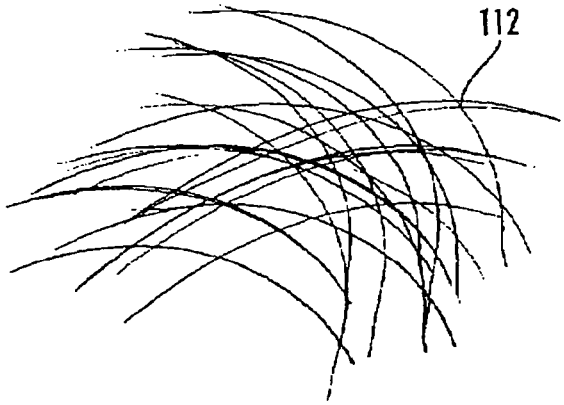
Figure 5
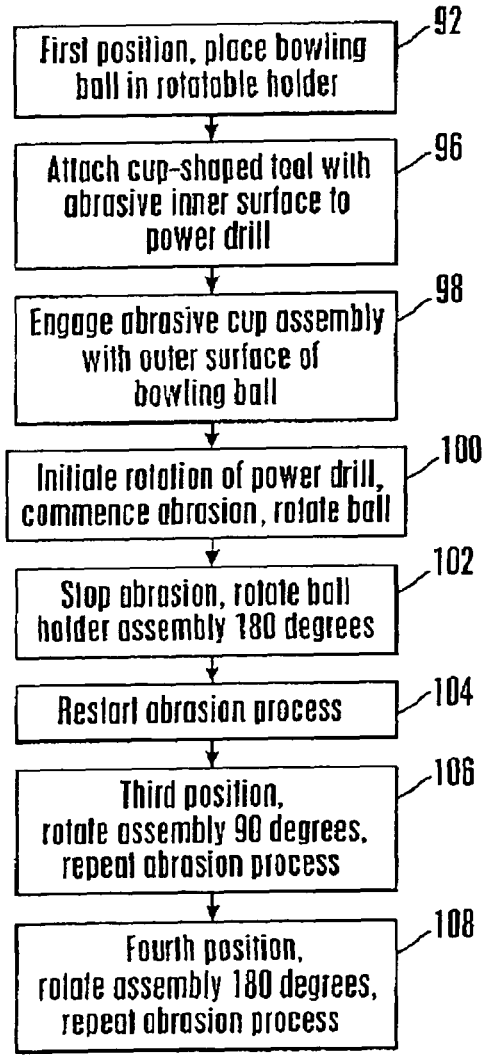

BOWLING BALL ABRADER AND POLISHER SYSTEM AND METHOD

RELATED APPLICATIONS

The present application claims priority under 35 U.S.C. 119(e) to U.S. Provisional Patent Application, Ser. No. 61/143,894, filed Jan. 12, 2009, which is incorporated by reference herein.

BACKGROUND OF THE INVENTION

1. Field of the Invention

The present invention relates to abrading and polishing tools and, more particularly, to such tools as are useful for refinishing a surface on a bowling ball. More specifically, the present invention relates to a tool assembly for abrading and polishing the outer surface of a bowling bail.

2. Description of the Related Art

The outer surface of a bowling ball is susceptible to wear and scratching during use, as it impacts, initially skids, and then rolls down the lane towards impact with the pins. Such wear tends to be uneven, and the resulting unpredictable and irregular spin, as well as a loss of 'trueness" while rolling produces inconsistent results and lower scores. Casual bowlers may not even notice, but league bowlers and professionals are more attuned to their games, and will more readily realize the problem. Such an owner is presented with the choice of repairing these surface problems or replacing their old ball with a new bowling ball.

Many owners prefer resurfacing (also known as refreshing) their old bowling ball, due both to cost and as a result of familiarity with their present bowling ball. Commercial-grade refinishing equipment is available; however, many bowlers are reluctant to hand over their bowling balls to operators of questionable skill, and would prefer to abrade and polish their bowling balls themselves. The simplest procedure utilizes sandpaper and polishing cloths placed against a stationary bowling ball, the user moving the sandpaper and cloth over the surface of the ball. Unfortunately, this method usually results in uneven abrading and finishing, increasing the rolling problems of the ball. In addition, the wear discussed above is subtle—at least with respect to the human eye, and it is essentially not possible for someone to hand polish a bowling ball to trueness where the bowling ball is held stationary.

Other simple methods make use of machines that cause the bowling ball to rotate, and the sandpaper and polishing cloths are held against the rotating ball. There are two problems with this approach, the first is similar to the stationary-ball polishing method—uneven hand pressure results in uneven surface wear, which at best doesn't resolve the initial problem, and at worst, makes the ball unusable. A second problem is familiar to users of machine sanders—if the user is not careful, the abrasive is continually applied to the same surface, resulting in unintentional, rapid surface wear that again results in a bowling ball that does not roll true.

There continues to exist a need for a bowling ball surface finisher that is affordable, easy to use, and provides consistent, reliable results towards obtaining a bowling ball having a surface similar to the 'factory finish."

DISCLOSURE OF THE INVENTION

The present invention provides a multi-function portable tool for sanding and polishing the surface of a howling ball. The Abrader and Polishing System™ includes several innovative components that cooperatively operate to obtain a total maintenance system that prepares high-performance bowling balls for any and all lane conditions.

The unique non-motorized rotating bowling ball holder/cup assembly differs from other known bowling ball abraders and polishers.

When utilized with the hand held drill-powered rotating spinning cup, the specially designed non-motorized rotating bowling ball holder induces the formation of unique, multiple small round concentric sanding scratch patterns on the ball surface, that is similar to the factory finish produced by ball manufacturers.

In contrast, other abrader/polishers produce substantially straight sanding scratch patterns.

The concentric patterns formed using the present invention provide a more even surface on the bowling ball that is intended to result in a more consistent and reliable grip of the lane surface.

The cup-shaped abrading and polishing tool may be used in both a powered and non-powered application. In one preferred embodiment, the cup-shaped tool is utilized with a hand-operated variable speed power drill. The power drill causes the cup-shaped tool to spin, and as the tool is held against the surface of a bowling ball, the spinning of the tool results in the rotation of the bowling ball as it is seated upon and received by the specially designed non-motorized rotating ball holder assembly.

When utilized in a non-powered application, a handle is provided, permitting a riser to grip the cup-shaped tool, enabling it to comfortably fit in the palm of the hand. While being so held, a user presses the tool against the surface of a rotating bowling ball, providing a uniform application of the abrading/polishing tool over the entire surface of the bowling ball.

The cup-shaped tool is molded to conform to over substantially one fifth of the area, as shown in FIG. 1, over the outer, spherical surface of a bowling ball.

A presently preferred fabrication material is a rigid plastic, with a presently preferred method of manufacture is injection molding using an ABS plastic (plastics based on acrylonitrile-butadiene-styrene copolymers).

When fabricating the cup-shaped tool for the powered application, a shaft is preferably inserted into the center of the tool, accommodating the attachment of the tool to an electric hand drill. The non-powered, or hand-held, version is made using the same materiel and in the same geometric shape, but utilizing a handle or knob in place of the shaft. Utilization of the non-powered cup-shaped tool is considered especially beneficial for the more minor bowling ball surface adjustments. The tool is held in the hand and a ball is rotated inside the concave surface of tool, or rotated or top of the ball held in a cup holder, or non-motorized rotating ball spinner.

On the concave side of the cup-shaped tool, hook fastener tape is secured, facilitating attachment of an abrasive pad at least substantially 6 inches in diameter having a loop-fastener cloth backing, foam center and abrading material face. When utilized in a power application, the shaft of the cup-shaped tool is inserted into the hand held powered drill, which provides the rotation necessary for even sanding of the surface of the bowling ball. Once sanded, a cloth bonnet is slipped over the cup-shaped opening to obtain finish-polishing of the surface.

It is to be understood that the invention is not limited in its application to the details of construction and the arrangement of components described hereinafter and illustrated in the drawing figures. Those skilled in the art will recognize that various modifications can be made without departing from the scope of the invention.

BRIEF DESCRIPTION OF THE DRAWINGS

Embodiments in accordance with the present invention are described below in connection with the e described below in connection with the accompanying drawing figures in which:

FIG. 1 is a partial perspective view showing a powered application of a bowling ball abrader and polisher as used to abrade and polish a bowling ball in accordance with the present invention;

FIG. 2A is an exploded perspective view, with portions in phantom, of the bowling ball abrader and polisher, showing a cup-shaped tool and abrasive liner and a non-motorized rotating ball holder assembly in accordance with the present invention;

FIG. 2B is a cross-sectional view, taken along line 2B-2B of FIG. 2A, showing placement of ball bearings within a non-motorized rotating ball holder assembly in accordance with the present invention;

FIG. 2C in an exploded cross-sectional view, taken along line 2B-2B of FIG. 2A and similar to FIG. 2B showing ball bearing placement;

FIG. 3 is a side elevation view of a cup-shaped tool with a polishing cloth received thereon;

FIG. 4 is a cross-sectional view, taken along line 4-4 of FIG. 3, showing a manner of attachment of a polishing cloth to a cup-shaped tool in accordance with the present invention;

FIG. 5 is a flowchart of a method of using a bowling ball abrader and polisher system in accordance with the present invention;

FIG. 6 is an illustration of an abrasion pattern on a bowling ball surface upon utilization of a powered cup-shaped tool on a substantially stationary bowling ball; and FIG. 7 is an illustration of an abrasion pattern on a bowling ball surface upon utilization of a powered cup-shaped tool on a bowling ball received within a non-motorized rotating ball holder assembly in accordance with the present invention.

DETAILED DESCRIPTION OF THE PREFERRED EMBODIMENTS

Reference is now made to the drawings wherein like numerals refer to like parts throughout. In FIG. 1, a powered abrader and polisher 10 is shown in use to repair surface defects in a bowling ball 14. A cup-shaped tool 18 utilizes an inner abrasive surface 22 formed within an inner cavity 24 (see FIG. 2A) of the cup-shaped tool 18 to remove surface detects from the bowling ball 14. A hand held power drill 26 attaches to the cup-shaped tool 18 using a centrally-located projecting shaft 28.

The bowling ball 14 is received by a non-motorized rotating ball holder assembly 32, that includes retaining cup holder 34 into which the bowling ball 14 is placed. The cup holder 34 is attached to (or is formed as part of) a rotatable top case 38, which is in turn supported by a stationary base 42 that rests against a support surface (not shown) for the powered abrader and polisher 10.

When relatively minor surface treatment is required the cup-shaped tool 18 can be adapted for use as strictly a hand tool. As is shown in FIG. 2A a handle 48 is attached to the central projecting shaft 28—which can include outer threads for ease in attachment of the handle 48. As so provided a user can more easily manipulate the cup-shaped tool 18, guiding it as required while the bowling ball 14 (not shown in FIG. 2A) rotates using the non-motorized rotating ball holder assembly 32.

The inner abrasive surface 22 forms an inner surface of an abrasive pad 52. A plurality of attachment strips 56 are attached to the inner cavity 24 of the cup-shaped tool 18. Hook and loop surfaces 58 are formed on outer surfaces of the attachment strips 56 and on the abrasive pad 52 to retain the abrasive pad 52 within the inner cavity 24 of the cup-shaped tool 18. This manner of attachment permits a secure positioning of the abrasive pad 52.

As shown in FIG. 2A, the rotating ball holder assembly 32 consists of the rotatable top case 38 and the stationary base 42. A plurality of ball bearings 64 are provided within a circular carriage 66 that is placed between the rotatable top case 38 and the stationary base 42. As is best shown in FIGS. 23 and 2C, the circular carriage 66 provides support and separation for the upper and lower structures, in a manner permitting the free rotation of the top case 38 relative to the stationary base 42. The plurality of ball bearings 64 are maintained within a like plurality of bearing cages 68 that are evenly-spaced about the circular carriage 66. The bearing cages 68 are open at both ends, permitting the ball bearings 66 to freely rotate as the rotatable top case 38 rotates relative to the stationary base 42.

Returning again to FIG. 2A, the retaining cup holder 34 provides a ball-cradling surface 82 that receives and retains the bowling ball 14 while the latter undergoes abrading and polishing. The bowling ball-cradling surface 82 retains the howling ball 14 in position upon the non-motorized rotating ball holder assembly 32 as the latter rotates about a substantially vertical axis during abrading and polishing of the bowling ball 14.

In FIG. 3 a polishing bonnet 86 has been received by/over the cup-shaped tool 18. A preferred manner of attachment utilizes an elastic band 88 that is located around the collar of the polishing bonnet 86, with the elastic band 88 placed around and outside of the opening of the cup-shaped tool 18 (see also FIG. 4). In this manner the polishing bonnet 86 can easily be installed on, and removed from, the cup-shaped tool 18.

The polishing bonnet 86 is preferably a terry cloth polishing bonnet, such as is provided by BMC Manufacturing Company of Derby, Vt. These bonnets attach over the outer edge of the cup-shaped tool and conform to the contour thereof, as well as the contour of the bowling ball 14. Appropriate polishes, such as those polishes sold by Ebonite Powerhouse of Hopkinsville, Ky., are applied to the bowling ball surface and are buffed to a gloss finish using the powered cup-shaped tool 18 and polishing bonnet 86. Utilization of the rotating ball holder assembly 32 enables the polishing to be evenly accomplished over the entire surface of the rotating bowling ball 14.

When the cup-shaped tool 18 is utilized with the handle 48 instead of the power drill 26, the bowling ball 14 is caused to rotate on the non-motorized rotating ball holder assembly 32, and the cup-shaped tool is utilized in much the some manner as when it is rotating using the power drill 26. Alternatively, when minor abrading of the outer surfaces of the bowling ball 14 is desired, the cup-shaped tool 18 can be held up-right with the bowling ball received in the cup-shaped tool 18 and caused to rotate by the user- or, the cup-shaped tool 18 can be rotated on top of a stationary bowling ball 14 located in a stationary cup holder.

The cup-shaped tool 18 of the present invention is preferably fabricated out of a plastic material, and most preferably out of a molded plastic, having dimensions of 6½ inches in diameter at the opening and a central depth of 2 inches—the arc substantially identical to the mutes curvature of a bowling ball. A ⅜-inch shaft is provided for attachment to a power drill.

The non-motorized rotating ball holder assembly is preferably fabricated out of a molded or injected plastic, such as are offered by Rex Plastics Inc., of Vancouver, Wash., with the rotatable top case having a diameter of 5½ inches, and an inner ball cradling surface of 5 inches by ¾ inches.

A first manner of use of the abrader and polisher will now be described in the context of FIG. 5. A bowling ball is first cleaned to remove residual oil. As at 92 the bowling ball is then placed within the non-motorized rotating ball holder assembly with the grip facing up.

An abrasive pad at least substantially 6 inches in diameter having appropriate grit value is then selected, a 180 grit (extra course) is appropriate for removal of deeper scratches; 360 grit (course) for deep scratches; 500, 600, an 800 grit (fine) for light scratches; 1000 and 1500 grit (very fine) for "factory finishes"; 2000 and 3000 grit (super fine) for "factory finishes" and more length; and 4000 grit (ultra fine) for "factory finishes" and maximum length. Pre-cut 6-inch fabric backed, foam center abrasive pads are available from a number of sources, such as Abralon abrasive pads manufactured by KWH Mirka Ltd of Finland, and Sia Air abrasive pads, manufactured by Sia Abrasives, Inc., of Charlotte, N.C. Patent Number US2007/0128989 A1.

After selection the abrasive pad is placed into the cavity of the cup-shaped tool, shaping the abrasive pad to conform to the contour of the cup—forming some wrinkles in the foam-based pad as the circular pad is made to fit conical shape of the inner cavity. Attachment occurs as a result of contact between the loop-fastener cloth surface of the adhesive pad and the hook tapes located within the inner cavity. As at 96 the central projecting shaft is then fully inserted into the hand held power drill in much the same manner as a drill bit is inserted.

At 98 the drill and cup-shaped tool are then placed on top of the bowling ball prior to initiating rotation of the abrader. The power drill is preferably a variable speed drill, and rotation of the cup-shaped tool is initiated at 100, preferably at a slow speed, which also initiates or induces rotation of the ball held by the non-motorized rotating ball holder assembly.

The rotation speed of the cup-shaped tool is gradually increased—maximum rotation speed of the drill is not required for either abrasion or polishing. Rotation of the cup-shaped tool continues, permitting the ball, which is set upon the non-motorized rotating ball holder, to rotate about a substantially vertical axis of rotation, ensuring abrasion coverage over the entire top surface of the bowling ball.

At 102, upon completion of the desired degree of abrasion, the bowling ball is rotated 180 degrees, placing the grip at the bottom within the rotating ball holder. The abrasion process is restarted, as at 104, the cup-shaped tool again placed upon the top surface, rotation initiated, with the speed increased and the "new" top surface abraded by the rotating cup-shaped tool. Upon completion of this second surface, as at 106 the bowling ball is turned 90 degrees within the rotating ball holder the grip now to the abrader's left, and the cup-shaped abrading tool is again placed upon the top surface of the bowling ball with rotation again initiated as before. As at 108 a final 180 degree over-the-top rotation follows (the grip is now to the abrader's left), and rotation of the cup-shaped tool is again initiated, abrading the top surface of the bowling ball.

The abrasive pad is then changed out, with a finer grit selected, and these abrading steps are repeated to obtain a smoother outer surface finish. This process is continued with increasingly fine grit until obtaining the desired outer surface finish. Optionally, on the final grit abrading a small amount of water is sprayed onto the abrasive pad to obtain a still smoother surface finish. Only a small amount of water is required, and high rotational speed is not required for such wet sanding, and excessive speed will result in splatter.

Polishing is initiated by placement of the polishing bonnet over the cup, making sure to leave the abrasive pad in place within the cup. Prior to applying polish to the bowling ball surface, the surface should be wiped with a clean dry towel and a ball cleaner product should be applied and wiped dry.

Polish is then applied to the bowling ball surface, and the buffing pad is placed against the surface of the ball prior to initiating rotation by starting the drill. The same 4-turn process as was used in abrading is used when polishing/buffing the ball. To maintain a fresh polishing surface the polishing bonnet can be turned inside-out after two turns (turns in the holder providing new bowling bail surfaces for polishing) and re-attached to the cup for the final two turns. Polishing bonnets should be washed after each use.

Utilization of the non-motorized rotating ball holder and the resultant induced rotation during abrasion and polishing enables the even and consistent surface treatment over the entire surface of the bowling ball. Instead of the substantially one-directional abrasion pattern 110 of FIG. 6, utilization of the rotating ball holder assembly results in the multi-directional abrasion pattern 112 shown in FIG. 7 resulting in a smoother surface and a bowling ball that rolls true.

Our invention has been disclosed in terms of a preferred embodiment thereof, which provides a bowling ball abrader and polisher system that is of great novelty and utility. Various changes, modifications, and alterations in the teachings of the present invention may be contemplated by those skilled in the art without departing from the intended spirit and scope thereof. It is intended that the present invention encompass such changes and modifications.

We claim:

1. A bowling ball abrader and polisher comprising:

a cup-shaped tool having a central axis and an inner cavity, said inner cavity conforming in curvature of substantially over one fifth of the outer surface of a bowling ball;

a fabric, foam center abrasive pad which is substantially 6 inches in diameter attached to said cup-shaped tool and extending in a substantially uniform manner over said inner cavity; and a non-motorized rotating ball holder assembly comprising:

a rotatable top case having a ball cradling surface formed in an upper surface of said rotatable top case, said cradling surface conforming in curvature to said outer surface of the bowling ball, and a stationary base attached to said rotatable top case in a mariner enabling relative rotation between said rotatable top case and said stationary base, wherein said rotating ball holder cooperatively rotationally inter-engages with said cup-shaped tool upon placement of said outer surface of the bowling ball within said inner cavity and receipt of said outer surface of the bowling ball by said inner ball cradling surface.

2. The abrader and polisher of claim 1, and further comprising a central projecting shaft attached to said cup-shaped tool and extending from a surface opposite said inner cavity and along said central axis.

3. The abrader and polisher of claim 2, and further comprising a handle attached to said central projecting shaft.

4. The abrader and polisher of claim 2, and further comprising a hand held power drill attached to said central projecting shaft.

5. The abrader and polisher of claim 4, wherein said abrasive pad is attached to said cup-shaped tool using hook and loan fasteners.

6. The abrader and polisher of claim 1, and further comprising a plurality of ball bearings received by and between said rotatable top case and said stationary base in a manner wherein said plurality of ball bearings support said rotatable top case in a manner enabling said relative rotation between said rotatable top case and said stationary base.

7. The abrader and polisher of claim 1, and further comprising a polishing bonnet received by and attached to said cup-shaped tool in a manner extending said polishing bonnet over said inner cavity.

8. A method of abrading and polishing a bowling ball, which comprises;

(a) placing the bowling ball upon a non-motorized rotating ball holder assembly;

(b) attaching a cup-shaped tool having an inner abrasive surface of substantially over one fifth of the outer surface of a bowling ball, to a power drill;

(c) applying the inner abrasive surface against an outer surface of the bowling ball placed upon the non-motorized rotating ball holder assembly and initiating rotation of the cup-shaped tool;

(d) inducing rotation of the bowling ball by maintaining the inner abrasive surface in rotational abrading contact with the outer surface of the bowling ball;

(e) displacing the bowling ball a first time within the non-motorized ball holder assembly by rotating the ball 180 degrees and repeating steps (c) and (d);

(f) displacing the bowling ball a second time within the non-motorized rotating ball holder assembly by rotating the ball 90 degrees and repeating steps (c) and (d); and (g) displacing the bowling ball a third time within the non-motorized rotating ball holder assembly by rotating the ball 180 degrees and repeating steps (c) and (d).

9. The method of abrading and polishing of claim 8, and further comprising:

attaching a fabric backed, foam center abrasive pad at least substantially 6 inches in diameter within an inner cavity of the cup-shaped tool.

10. The method of abrading and polishing of claim 9, and further comprising:

selecting an abrasive pad of desired grit value.

11. The method of abrading and polishing of claim 8, and further comprising:

attaching a polishing bonnet to overlay the inner abrasive surface.

12. The method of abrading and polishing of claim 11, and further comprising:

applying a polishing compound to the outer surface of the bowling ball.

* * * * *